United States Patent [19]

Middlebrook

[11] 4,236,715

[45] Dec. 2, 1980

[54] AMUSEMENT DEVICE OF COATED PAPER AND ADHERABLE OBJECT OF OIL-EXTENDED RADIAL TELEBLOCK COPOLYMER

[75] Inventor: Terence C. Middlebrook, Bartlesville, Okla.

[73] Assignee: Phillips Petroleum Company, Bartlesville, Okla.

[21] Appl. No.: 943,826

[22] Filed: Sep. 19, 1978

[51] Int. Cl.[3] ..... A63B 63/00; A63B 69/40; A63F 7/30

[52] U.S. Cl. ..... 273/95 R; 273/102 R; 273/106 R; 273/58 J; 428/355; 260/33.6 AQ; 260/998.14

[58] Field of Search ..... 273/95 R, 102 R, 106 R

[56] References Cited

U.S. PATENT DOCUMENTS

| | | | |
|---|---|---|---|
| 3,052,539 | 9/1962 | Greig | 96/1 |
| 3,121,006 | 2/1964 | Middleton et al. | 96/1 |
| 3,265,765 | 8/1966 | Holden et al. | 260/876 |
| 3,434,994 | 3/1969 | Smit | 260/29.7 |
| 3,485,787 | 12/1969 | Haefele et al. | 260/33.6 |
| 3,676,387 | 7/1972 | Lindlof | 260/28.5 B |
| 3,738,951 | 6/1973 | Middlebrook | 260/23.7 M |
| 3,827,999 | 8/1974 | Crossland | 260/33.6 AQ |
| 3,865,776 | 2/1975 | Gergen | 260/33.6 AQ |
| 3,939,112 | 2/1976 | Needham | 260/33.6 AQ |
| 3,945,977 | 3/1976 | Snavely | 260/33.6 AQ |

OTHER PUBLICATIONS

Chem. & Eng. News (ACS) Jul. 13, 1964, pp. 114–125, 127–131.

Chem. & Eng. News (ACS) Jul. 20, 1964, pp. 84–94, 96.

*Primary Examiner*—M. Tillman

*Assistant Examiner*—Arthur H. Koeckert

[57] ABSTRACT

An amusement device in which a shaped object prepared from a blended mixture of highly oil-extended butadiene-styrene radial teleblock copolymers adheres on impact to the flat surface of a target material.

6 Claims, No Drawings

AMUSEMENT DEVICE OF COATED PAPER AND ADHERABLE OBJECT OF OIL-EXTENDED RADIAL TELEBLOCK COPOLYMER

BACKGROUND OF THE INVENTION

This invention relates to amusement devices. And one of the aspects of this invention relates to amusement devices in which an object is propelled toward a target. And another of the aspects of this invention relates to the combination of material of construction for a propelled object and a target such that the propelled object adheres on impact to the target material. In another of its aspects this invention relates to the flat surface composed of material to which a highly oil-extended butadiene-styrene radial teleblock copolymer molded object adheres on impact.

It has been disclosed in U.S. Pat. No. 3,676,387 that balls prepared from butadiene-styrene linear teleblock copolymers extended with a high level of a nonaromatic paraffinic oil (aromatic, naphthenic, and cyclic containing oils are unsuitable for this product) upon being thrown against a surface do not rebound; but, rather, suffer momentary, extreme deformation returning after brief elapse of time to their original shape so that on a vertical surface they continue to adhere, but slowly roll down the surface.

It has been observed that this same type of occurrence takes place with balls prepared from butadiene-styrene radial teleblock copolymers extended with high levels of all kinds of hydrocarbon oils, i.e., naphthenic, paraffinic, aromatic, or mixtures thereof. It has been further observed that with certain, specific types of surface, balls prepared from butadiene-styrene radial teleblock copolymers have a minimal tendency to roll down the surface, tending instead to stick in place when impacted against vertical surfaces as described herein.

Since target amusement devices have always been popular and since elimination of sharp points from the missiles propelled toward a target has become a prime consideration in the design of such devices, the combination of the ability to stick to a flat surface exhibited by objects made from butadiene-styrene radial teleblock copolymers and the special affinity of certain specific surfaces or surface coatings for tending to hold highly oil-extended butadiene-styrene radial teleblock copolymer molded objects in place upon impact is considered fortuitous for the design of a target-type amusement device that is particularly safe to use.

It is therefore an object of this invention to provide an amusement device. It is a further object of this invention to provide a target-type amusement device in which the propelled object adheres to the target without depending upon the penetration of the target by sharp protrusions for adherence. It is another object of the invention to provide a surface to which an object molded from butadiene-styrene radial teleblock copolymers extended with high levels of hydrocarbon oils will adhere upon impact.

Other aspects, objects and the various advantages of this invention will become apparent from reading the specification and the appended claims.

STATEMENT OF THE INVENTION

According to this invention an amusement device is provided in which a shaped object prepared from a blended mixture of butadiene-styrene radial teleblock copolymers and a high level of hydrocarbon extender oils adheres on impact to a flat surface. The surface with which the molded object is impacted is composed of or coated with a material which promotes the tendency of the copolymer to stick and minimizes the tendency of the copolymer to roll or slide down a vertical surface.

The preparation of the molded objects which serve as missiles for this amusement device is set out in detail in copending application Ser. No. 892,797, filed Apr. 3, 1978 which is a continuation-in-part of Ser. No. 799,030, filed May 20, 1977, now abandoned. In that application it is stated that among the conjugated diene/vinyl aromatic teleblock copolymers which can be oil-extended and cast into useful objects are radial or branched teleblock copolymers of butadiene and styrene which are prepared by methods which are well known in the art. For example, use of an organolithium initiating species to polymerize styrene monomer to form a living polymer of polystyryllithium represented by:

polystyrene—Li followed by addition of butadiene monomer to the polystyryllithium to form a living polymer represented by polystyrene-polybutadiene-Li and subsequent coupling of the living polymer with a multifunctional coupling agent, such as silicon tetrachloride, results in polymers which are represented by $$(\text{polystyrene-polybutadiene})_n\text{Y}$$

where Y represents a coupling agent residue and n is a number greater than 2 and preferably from 3 to 5. Such polymers are characterized as being elastomeric in the unvulcanized state as well as thermoplastic since they can be molded.

Useful polymers which also contain outward polystyrene blocks and inward polybutadiene blocks can be prepared by employing a polyfunctional initiating species, such as an organopolylithium compound, into which polybutadiene blocks are polymerized with subsequent polymerization of polystyrene blocks. Such copolymers are represented by $$(\text{polystyrene-polybutadiene})_n\text{Z}$$

wherein Z represents the residue of the polyfunctional initiating species and n is as described above.

The copolymers will generally contain from about 50 to 95 weight percent butadiene and from about 5 to about 50 weight percent styrene; preferably from about 50 to about 70 weight percent butadiene and about 30 to about 50 weight percent styrene. Copolymers particularly useful in producing compositions that do not rebound from surfaces against which they are thrown are in this preferred range—most particularly in the range of about 60 to 70 weight percent butadiene. At least a minimal amount of styrene is required for the copolymers to possess the requisite green tensile strength. About 5 to 10 weight percent styrene satisfies this requirement. More than about 50 weight percent styrene in the copolymer results in a composition in which hardness is increased at the expense of elasticity. Useful copolymers will generally exhibit a weight average molecular weight in the range of about 75,000 to about 500,000, but a range of about 100,000 to about 350,000 is preferable.

It is also within the scope of this invention to employ radial block copolymers in which the above-described polybutadiene block is not pure polybutadiene but is a block of random butadiene/styrene copolymer of a "tapered" block of butadiene and styrene in which the ratio of butadiene to styrene changes from one end of the block to the other. If such polymers are employed the amount of butadiene and styrene in the total polymer must be within the ranges given above, with the further proviso that the above-described polystyrene blocks must constitute at least 5 percent by weight of the total polymer.

The oil which is useful in the practice of this invention is generally selected from those hydrocarbon oils characterized as naphthenic, paraffinic, or aromatic or mixtures thereof. Commercial oils, although typically classified as one of these types, normally are mixtures and are usually classified according to major component. Impurities such as unsaturated heterocyclic compounds and aromatic heterocyclic compounds can also be present in small amounts. Oils which are referred to in the industry as heavy white mineral oils are also suitable as extender oils for rubbery polymers. These are usually produced by refining a naphthene-base oil or a mixed naphthene-paraffin-base oil by removal of all heterocyclic, unsaturated aliphatic, and aromatic hydrocarbons. Oils in which this removal is not complete are often described as technical grade white mineral oils, whereas when the removal of these impurities is essentially quantitative the product is identified as a U.S.P. white mineral oil. Naphthenic oils (including heavy white mineral oils) are generally preferred because they do not usually impart an undesirable color to the composition and they exhibit less tendency to exude or "bleed" from the composition. Aromatic oils are normally used in applications where color of the finished product is not critical, since commercially available aromatic oils generally have characteristic color associated with them. Exudation or "bleed-out" of oil is most likely to occur with oils high in paraffinic content, but is also a function of the physical properties of the oil, such as, for example, viscosity and specific gravity. Exudation is also a function of the rubber used in the composition, heavy white mineral oils and naphthenic oils generally exhibiting less exudation with rubbers which have high conjugated diene content. Some degree of exudation or slow release of oil is desirable or tolerable for specific end-uses. It is also within the scope of this invention to employ vegetable oils in the compositions. The choice of oil for a specific application depends on several factors, such as, for example, the rubber chosen, the degree of exudation desired or allowable, and the required color of the finished product.

It is frequently desirable to include other additives well known in the rubber art in the inventive compositions. Stabilizers, antioxidants, fillers, reinforcing agents, reinforcing resins, dyes, pigments, fragrances, and the like are examples of such types of additives. Specific examples of useful antioxidants and stabilizers include 2-(2'-hydroxy-5'-methylphenyl)benzotriazole, nickel dibutyldithiocarbamate, tris(nonylphenyl)-phosphite, 2,6-di-t-butyl-4-methylphenol, and the like. Exemplary fillers, reinforcing agents, and pigments include clay, silica, carbon black, titanium dioxide, and the like. Titanium dioxide in a range up to about 500 parts per hundred parts by weight copolymer is of special usefulness in producing shaped objects that do not rebound from a vertical surface against which they are thrown. Both the addition of titanium dioxide and a high ratio of butadiene to styrene in the composition have been demonstrated to improve the ability of shaped objects of this invention not to rebound from surfaces against which they are thrown (the disclosure of Ser. No. 892,797, filed Apr. 3, 1978, is incorporated here by reference). Polypropylene and polystyrene are examples of thermoplastic resins which function as reinforcing resins.

The compositions of this invention generally contain the above-described ingredients in amounts given in the following tabulation:

| Ingredient | Parts by Weight per 100 Parts by Weight of Radial Teleblock Copolymer | |
|---|---|---|
| | Broad | Preferred |
| Oil | 200–1000 | 300–700 |
| Filler or reinforcing agent | 0–500 | 3–70 |
| Reinforcing resin | 0–200 | 0–100 |
| Stabilizer | 0–5 | 0.5–3 |
| Pigment | 0–10 | 0.05–1 |

The compositions of this invention can be prepared by any of the means well known in the art for combining the above ingredients such as solution blending, milling or continuous extrusion followed by sufficient heating of the blended composition to produce a fluid state for molding. The fluid composition can be placed in a mold and allowed to cool and solidify. Alternatively, the composition can be cooled in bulk with subsequent sufficient heatings to produce a fluid state for molding, casting, or other uses. Molding can be accomplished by well-known techniques such as by injection, compression or transfer techniques or simply by pouring the hot fluid composition into a mold.

Although the shape most specifically contemplated for use in this invention is a spheroid or ball, objects of any shape can be used. Of particular interest are objects sized to be easily thrown by hand or projected by a spring loaded mechanism or other propelling device. The object can be regular as a parallelepiped, spheroid, dodecahedron, etc., or totally irregular in shape, but with sufficient surface to allow adherence to a vertical surface. There must be that relationship between the amount of flat surface on the molded object that is impacted against the vertical surface and the total weight of the object that makes it able to "stick" to the vertical surface.

Several types of surfaces or surface treatments have been found especially suitable for promoting adherence of molded shaped article upon impact with the vertical surface. One of the most suitable surfaces that has been found is the copy side of duplicating paper such as that used in an Addressograph-Multilith Copier 5000. This type of copier is based on the direct electrostatic process (Electrofax process), and commercial papers used in this process are typically coated with zinc oxide held on the paper by a high electrical resistance binder. It is well known that inorganic photoconductive insulating compounds suitable for such papers include zinc sulfide, zinc-cadmium sulfide, zinc-magnesium oxide, zinc selenide, cadmium selenide, zinc silicate, calcium-strontium sulfide, cadmium sulfide, mercuric iodide, mercuric oxide, mercuric sulfide, indium trisulfide, gallium triselenide, antimony trisulfide, red lead ($Pb_3O_4$), titanium dioxide, and zinc titanate. Presently preferred for the purposes of this invention is zinc oxide. Suitable binders for holding these metallic coatings on the paper base include polyvinyl acetate, copolymers of vinyl chloride-vinyl acetate, polystyrene, acrylic and methacrylic ester polymers, chlorinated rubber, cellulose esters and ethers such as ethyl cellulose or nitrocellulose, alkyd resins, silicone resins, shellac, paraffin wax, carnauba wax, and butadiene copolymers.

Another surface material that has been found suitable for the impact adherence of the copolymer balls used in this invention is asbestos board, such as that used as exterior building siding or as laboratory table tops. Another suitable material is the Celotex material used for ceiling tiles. And yet another surface is poured concrete that has been formed against plywood.

Any of these surfaces can be prepared with a bull's eye or other type target thereon. The target surface on a suitable backing and support can then be disposed in a position in which the molded objects useful as projectiles in this invention can be impacted on the surface.

As an example of the present invention a mixture of 70/30 butadiene-styrene radial block copolymer with 300 parts by weight Marathon-Norco U.S.P. heavy white mineral oil and 20 parts by weight $TiO_2$ per 100 parts of the rubber was blended. All of the ingredients were mixed in a pan and placed in an oven without further stirring for 30 minutes at 164° C. The composition was allowed to cool and the masterbatch was blended in a roll mill for about five minutes at 120° C. The material was molded into balls. The balls made from this material were thrown against a vertical surface covered with a paper coated with zinc oxide specifically the copy side of the duplicating paper used in an Addressograph-Multigraph Copier 5000. On impact the balls stuck to the vertical surface of the target.

I claim:

1. An amusement device comprising (1) a shaped object prepared from a blended mixture of butadiene-styrene radial teleblock copolymers and hydrocarbon oil and (2) a target material of sufficient size for the shaped object to adhere thereon, said target material comprised of a material to which said shaped object adheres on impact chosen from a paper base coated with a compound selected from among zinc sulfide, zinc-cadmium sulfide, zinc-magnesium oxide, zinc selenide, cadmium selenide, zinc silicate, calcium-strontium sulfide, indium trisulfide, gallium triselenide, antimony trisulfide, red lead ($Pb_3O_4$), titanium dioxide, zinc titanate, and zinc oxide.

2. An amusement device of claim 1 in which said material to which the shaped object adheres is chosen from a paper base coated with a compound selected from among zinc sulfide, zinc-magnesium oxide, zinc silicate, titanium dioxide, zinc titanate, and zinc oxide.

3. An amusement device of claim 1 or 2 wherein the coating of the paper contains a binder selected from among polyvinyl acetate, copolymers of vinyl chloride-vinyl acetate, polystyrene, acrylic and methacrylic ester polymers, chlorinated rubber, cellulose esters and ethers, alkyd resins, silicone resins, shellac, paraffin wax, carnauba wax, and butadiene copolymers.

4. An amusement device of claim 3 wherein said butadiene-styrene radial teleblock copolymers contain from about 50 to about 70 weight percent butadiene and from about 30 to about 50 weight percent styrene.

5. An amusement device of claim 3 wherein said blended mixture comprises additives chosen from among stabilizers, antioxidants, fillers, reinforcing agents, reinforcing resins, pigments, dyes and fragrances.

6. An amusement device of claim 3 wherein said shaped object is in the shape of a spheroid.

* * * * *